US012758046B2

(12) United States Patent
Hammill et al.

(10) Patent No.: US 12,758,046 B2
(45) Date of Patent: Oct. 13, 2026

(54) SELF-HELP CLASP TOOL

(71) Applicants: Amaya Niqol Hammill, Virginia Beach, VA (US); Chloe Kennedy Hoffman, Virginia Beach, VA (US); Amira Nicole West, Virginia Beach, VA (US); Yasmine Sophia Marsden, Virginia Beach, VA (US)

(72) Inventors: Amaya Niqol Hammill, Virginia Beach, VA (US); Chloe Kennedy Hoffman, Virginia Beach, VA (US); Amira Nicole West, Virginia Beach, VA (US); Yasmine Sophia Marsden, Virginia Beach, VA (US)

( * ) Notice: Subject to any disclaimer, the term of this patent is extended or adjusted under 35 U.S.C. 154(b) by 0 days.

(21) Appl. No.: 19/080,242

(22) Filed: Mar. 14, 2025

(65) Prior Publication Data

US 2026/0272199 A1 Sep. 17, 2026

(51) Int. Cl.
*A47G 25/90* (2006.01)

(52) U.S. Cl.
CPC ..... *A47G 25/90* (2013.01); *A47G 25/901* (2013.01)

(58) Field of Classification Search
CPC .... A47G 25/90; A47G 25/901; A47G 25/902; A47G 25/92
See application file for complete search history.

(56) References Cited

U.S. PATENT DOCUMENTS

| | | | | |
|---|---|---|---|---|
| 597,883 | A * | 1/1898 | Kepler | A41F 19/00 24/15 |
| 2,981,507 | A * | 4/1961 | Dawson | G09F 1/14 63/11 |
| 4,734,973 | A * | 4/1988 | Longo | A47G 25/901 29/283 |
| 6,854,625 | B2 * | 2/2005 | Tedeschi | A47G 25/901 223/111 |
| 9,924,819 | B2 * | 3/2018 | Talberg | A47G 25/901 |
| 2025/0229384 | A1 * | 7/2025 | Portilla | A47G 25/901 |

FOREIGN PATENT DOCUMENTS

| | | | | |
|---|---|---|---|---|
| BE | 1005169 | A5 * | 5/1993 | A47G 25/901 |
| DE | 20005428 | U1 * | 7/2000 | B25B 9/02 |

* cited by examiner

*Primary Examiner* — F Griffin Hall
(74) *Attorney, Agent, or Firm* — Emdadi Patent Law; Kamran Emdadi

(57) ABSTRACT

A device for assisting a user to secure a bracelet includes a first arm with a hook at a first end, a second arm with a clamp at a first end, and the first arm and the second arm are connected at their respective second ends via a connected portion which separates the first arm and the second arm by a fixed angle.

4 Claims, 2 Drawing Sheets

SELF-HELP CLASP TOOL

TECHNICAL FIELD

This application generally relates to a self-helping assistant tool and more particularly to a single device with two arms which includes a hook and a clasp.

BACKGROUND

Putting a necklace or bracelet or anklet (ankle chain) or waistlet (waist chain) on by yourself can be an arduous task. The tiny levers and other small elements can make the securing process time consuming and cumbersome. The process is basically a two hand job that requires fingers from both hands to complete the task. When putting on a bracelet, one hand is essentially useless since the fingers of that hand and the corresponding wrist receiving the bracelet cannot be used to help with the process. This makes a two hand job be performed by one hand unless of course you can solicit another person to assist. However, having another person around that is willing to help is not always an option.

SUMMARY

One example embodiment may provide a device with two arms which can be used to hold, maneuver and complete a bracelet securing process.

An example embodiment may include a device for assisting a user to secure a bracelet includes a first arm with a hook at a first end, a second arm with a clamp at a first end, and the first arm and the second arm are connected at their respective second ends via a connected portion which separates the first arm and the second arm by a fixed angle.

DETAILED DESCRIPTION

It will be readily understood that the instant components, as generally described and illustrated in the figures herein, may be arranged and designed in a wide variety of different configurations. Thus, the following detailed description of the embodiments of at least one of a method and an apparatus as represented in the attached figures, is not intended to limit the scope of the application as claimed, but is merely representative of selected embodiments.

Figure 1:
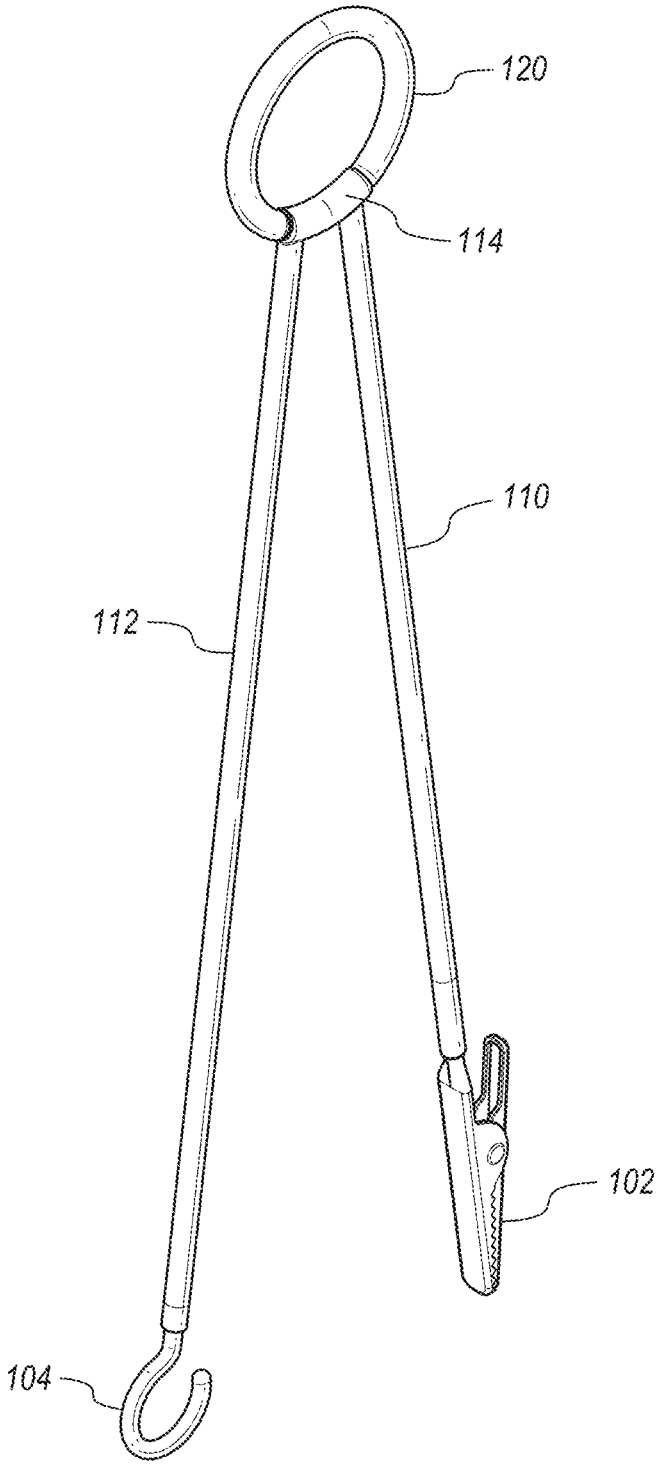
FIG. 1 illustrates an angled perspective of a bracelet securing device according to example embodiments.

FIG. 1 illustrates an angled perspective of a bracelet securing device according to example embodiments. Referring to FIG. 1, the two arms 110 and 112 may be joined together at a common base 114 which may be a same piece of material as the arms, such as a metal or a plastic. The first arm 110 may be attached to the second arm via an arcuate portion 114 which is a partial circular arc of material which separates the two arms by a designated angle. One example angle range between the arms as measured at the arcuate portion may be approximately 10 to 45 degrees. The support ring 120 may be a complete circle with a uniform surface area. Alternatively, the ring may have a depressed surface area at the portion of the ring that is covered by the hollow cylindrical portion of the arcuate portion 114 and that depressed surface area may be slightly smaller than the rest of the ring 120. In other words, the portion of the ring 120 that is covered by the arcuate portion 114 may have a same sized circumference or a smaller sized circumference than the other exposed portion of the ring 120 that is not covered by the arcuate portion (base) 114.

The material used may be plastic, metal, wood, rubber, poly-plastic compositions, etc. The material is generally flexible so the arms can bend towards one another during operation by a user. The arm 110 that is affixed to the alligator clamp 102 or other type of spring loaded clamp may be slightly shorter than the other arm 112 which is affixed to the hook 104. The reason for the shorter arm 110 is to permit the mouth of the alligator clamp 102 to be closer to the hook 104 since the clamp 102 may be a longer end piece than the hook 104.

In operation, a user may open and shut the clamp 102 on one bracelet end, effectively securing the bracelet end, and use the hook to secure the other bracelet end. The user may then pinch the arms 110 and 112 towards one another to bring the hook 104 and the alligator clamp 102 close together so the bracelet ends can meet close together and be easily secured by the user.

Figure 2:
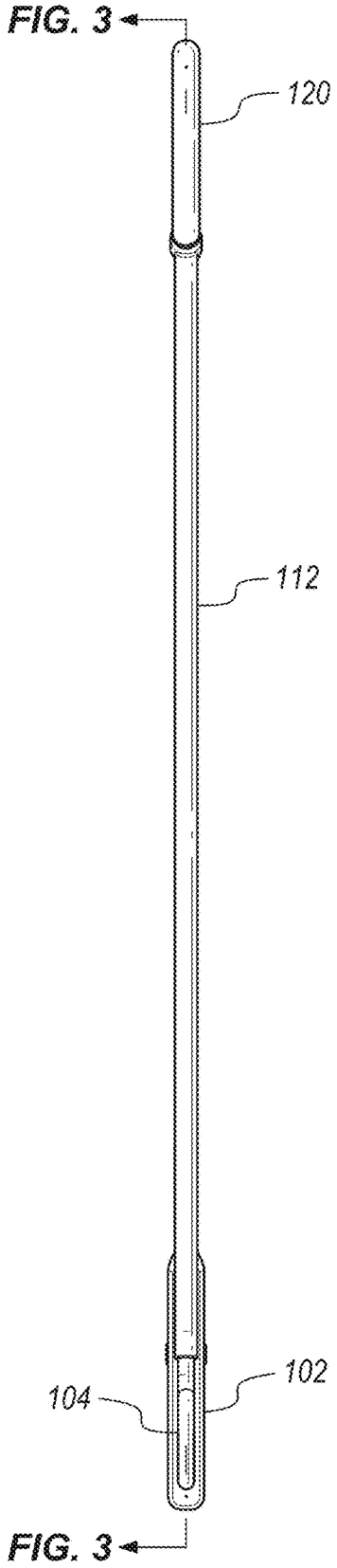
FIG. 2 illustrates a sideways perspective of the bracelet securing device according to example embodiments.

FIG. 2 illustrates a sideways perspective of the bracelet securing device according to example embodiments. Referring to FIG. 2, the ring 120 and the arms 110/112 may have a relatively similar thickness, however, the thicknesses of the arms 110/112 and the ring 120 may vary. The sizes of the alligator clamp 102 and the hook 104 may also vary.

Figure 3:
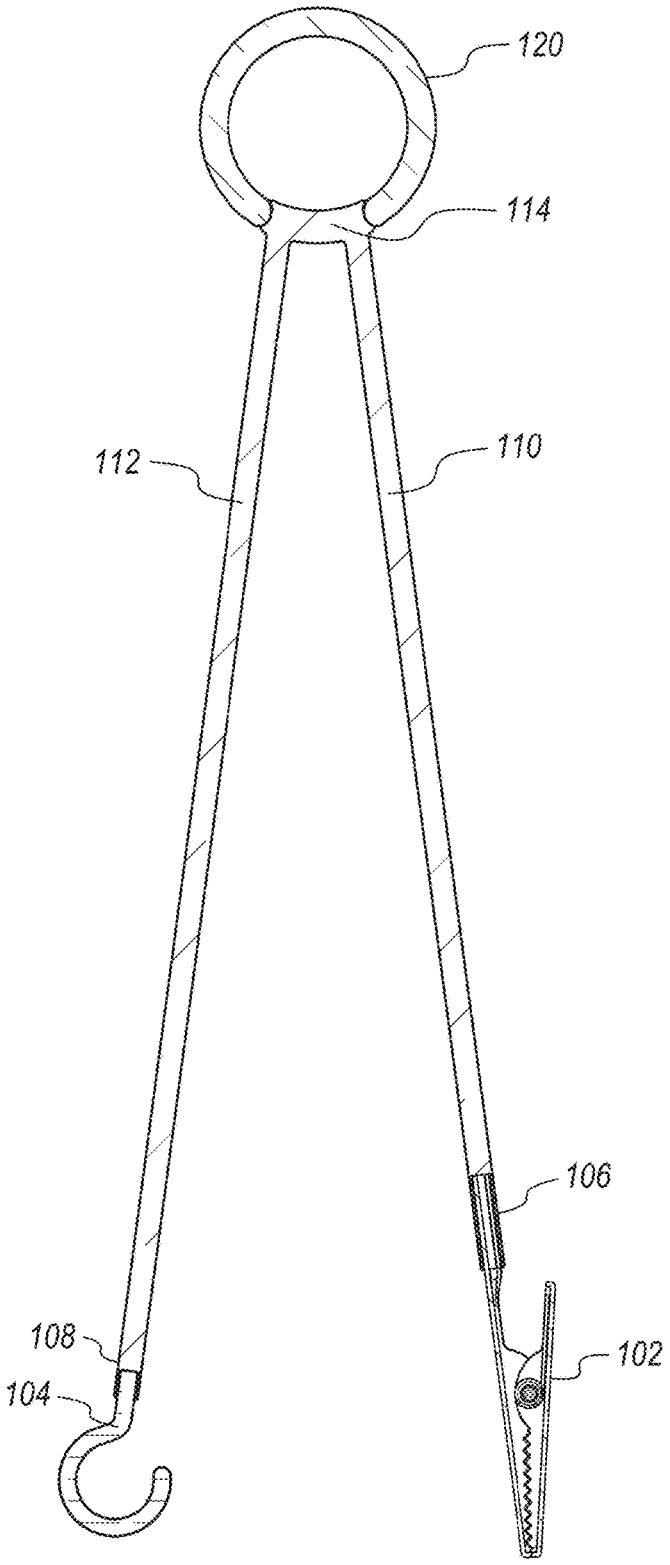
FIG. 3 illustrates a front perspective of the bracelet securing device according to example embodiments.

FIG. 3 illustrates a front perspective of the bracelet securing device according to example embodiments. Referring to FIG. 3, the hook 104 may be inserted into the hollow center 108 of the arm 112. Instead, the hook may have a hollow tube that is affixed over the arm 112. The alligator clamp 102 may have a hollow tube portion 106 that is affixed over the arm 110 or may have a rod with a smaller diameter than the arm 110 so the rod can be inserted into a hollow end of the arm 110. In operation, the two arms may be made of a flexible metal, such as a resilient metal, such as stainless steel, brass, or a metal with an added flex agent. The arms may also be made of a flexible plastic, wood, or other material that can be bent and which goes back to its original form. The two arms may be bent towards one another to bring the hook 104 and the alligator clamp 102 close together so the user can join the bracelet together. Once released the two arms 110 and 112 will move back to their respective resting positions.

The instant features, structures, or characteristics as described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

It will be readily understood that the components of the application, as generally described and illustrated in the figures herein, may be arranged and designed in a wide variety of different configurations. Thus, the detailed description of the embodiments is not intended to limit the scope of the application as claimed but is merely representative of selected embodiments of the application.

One having ordinary skill in the art will readily understand that the above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent.

While preferred embodiments of the present application have been described, it is to be understood that the embodiments described are illustrative only and the scope of the application is to be defined solely by the appended claims when considered with a full range of equivalents and modifications thereto.

What is claimed is:

1. A bracelet securing apparatus comprising:

a first arm comprising a hook at a first end of the first arm;

a second arm comprising a clamp at a first end of the second arm; and a ring;

wherein the first arm and the second arm are connected at their respective second ends via a base which separates the first arm and the second arm by an arcuate portion which is a partial circular arc which separates the two arms by a fixed angle, and wherein a portion of the ring is covered by the arcuate portion.

2. The apparatus of claim 1, wherein the fixed angle is greater than 10 degrees and less than 45 degrees.

3. The apparatus of claim 1, wherein the arms and the base are a same material which is plastic, wood or metal.

4. The apparatus of claim 1, wherein the first arm not including the hook is longer than the second arm not including the clamp.

* * * * *